US007595780B2

(12) United States Patent
Katagawa et al.

(10) Patent No.: US 7,595,780 B2
(45) Date of Patent: Sep. 29, 2009

(54) LIQUID CRYSTAL DISPLAY DEVICE

(75) Inventors: Koichi Katagawa, Kawasaki (JP); Yasutake Furukoshi, Kawasaki (JP); Katsuyoshi Hiraki, Kawasaki (JP)

(73) Assignees: Fujitsu Limited, Kawasaki (JP); Au Optronics Corporation, Hsinchu (TW)

( * ) Notice: Subject to any disclaimer, the term of this patent is extended or adjusted under 35 U.S.C. 154(b) by 894 days.

(21) Appl. No.: 10/900,961

(22) Filed: Jul. 28, 2004

(65) Prior Publication Data

US 2005/0083290 A1 Apr. 21, 2005

(30) Foreign Application Priority Data

Oct. 20, 2003 (JP) ..... 2003-359734

(51) Int. Cl.
*G09G 3/36* (2006.01)

(52) U.S. Cl. ..... 345/87; 345/99; 345/100

(58) Field of Classification Search ..... 345/87–95, 345/99–100, 204, 208, 213–214
See application file for complete search history.

(56) References Cited

U.S. PATENT DOCUMENTS 5,576,729 A * 11/1996 Yamazaki ..... 345/94
6,873,312 B2 * 3/2005 Matsueda ..... 345/98
2003/0085860 A1 * 5/2003 Baek ..... 345/87

FOREIGN PATENT DOCUMENTS

JP 5-046118 2/1993

* cited by examiner

*Primary Examiner*—Richard Hjerpe
*Assistant Examiner*—Mansour M Said
(74) *Attorney, Agent, or Firm*—Greer, Burns & Crain, Ltd.

(57) ABSTRACT

The liquid crystal display device has a liquid crystal panel in which liquid crystal cells are disposed in intersection areas of scanning lines and data lines, respectively. A picture signal and a synchronous signal are supplied via external terminals, respectively. A timing controller generates a driving timing of the scanning lines and a driving timing of the data lines in response to the synchronous signal. Further, the timing controller varies at least one of the driving timing of the scanning lines and the driving timing of the data lines according to a cycle of the synchronous signal in order to keep a writing time of the picture signal supplied to the liquid crystal cells constant. Therefore, it is possible to keep the writing time constant even when the cycle of the synchronous signal varies, which can prevent the deterioration in display quality.

19 Claims, 9 Drawing Sheets

LIQUID CRYSTAL DISPLAY DEVICE

CROSS-REFERENCE TO RELATED APPLICATIONS

This application is based upon and claims the benefit of priority from the prior Japanese Patent Application No. 2003-359734, filed on Oct. 20, 2003, the entire contents of which are incorporated herein by reference.

BACKGROUND OF THE INVENTION

1. Field of the Invention

The present invention relates to a technique for preventing the deterioration in display quality of a liquid crystal display device.

2. Description of the Related Art

Liquid crystal display devices are in wide use for display devices of notebook personal computers and desktop personal computers since their power consumption is small and they require only small installation space. In recent years, liquid crystal display devices for television and liquid crystal display devices for hand-held terminals such as cellular phones have been developed. Further, personal computers usable for viewing television broadcasting are being developed.

Due to diversity of products using liquid crystal devices, adaptability to various frame frequencies and horizontal frequencies are demanded of the liquid crystal devices. Here, the frame frequency indicates the display speed of a screen and corresponds to the display cycle of one screen. The horizontal frequency indicates the display speed of a horizontal line (display line) along each scanning line and corresponds to the display cycle of the horizontal line (a cycle of a horizontal synchronous signal).

A technique of correcting, when a picture signal supplied to the liquid crystal device and the horizontal synchronous signal do not coincide with each other, the difference therebetween and correctly displaying the picture signal has been proposed (for example, Japanese Unexamined Patent Application Publication No. Hei 5-46118).

Generally, driving signals to drive a scanning line and a data line of a liquid crystal panel is generated in synchronization with a synchronous signal (horizontal synchronous signal). Therefore, the timing of the driving signals of the liquid crystal panel varies in accordance with the variation in the cycle of the horizontal synchronous signal, which varies the writing time of the picture signal. Especially, the reduction in the cycle of the synchronous signal results in lack of the writing time to deteriorate display quality. Specifically, the reduction in the cycle of the synchronous signal results in lack of a timing margin, to the picture signal, of a gate clock signal for driving the scanning line and of a latch pulse signal for driving the data line, which causes problems such that a display area of the liquid crystal panel partly becomes dark. The same problem also arises when the cycle of the synchronous signal becomes shorter in accordance with the reduction of the frame cycle.

SUMMARY OF THE INVENTION

It is an object of the present invention to keep the writing time to a liquid crystal cell constant independently of the frequency of a synchronous signal supplied to a liquid crystal display device, thereby preventing the deterioration in display quality.

According to one of the aspects of the liquid crystal display device of the present invention, the liquid crystal display device has a liquid crystal panel in which liquid crystal cells are disposed in intersection areas of scanning lines and data lines, respectively. A picture signal and a synchronous signal are supplied via external terminals, respectively. A timing controller generates a driving timing of the scanning lines and a driving timing of the data lines in response to the synchronous signal. Further, the timing controller varies at least one of the driving timing of the scanning lines and the driving timing of the data lines according to a cycle of the synchronous signal in order to keep a writing time of the picture signal supplied to the liquid crystal cells constant. Therefore, it is possible to keep the writing time constant even when the cycle of the synchronous signal varies, which can prevent the deterioration in display quality.

According to another aspect of the liquid crystal display device of the present invention, the liquid crystal display device has an oscillator which generates an internal clock signal. The timing controller has a counter and a timing setting circuit. The counter counts the cycle of the synchronous signal as the number of clocks of the internal clock signal. The timing setting circuit sets at least one of the driving timing of the scanning lines and the driving timing of the data lines according to a counter value of the counter. The use of the internal clock signal whose cycle is always constant allows correct measurement of the cycle of the synchronous signal. As a result, the timing setting circuit can set at least one of the driving timing of the scanning lines and the driving timing of the data lines with high precision.

According to another aspect of the liquid crystal display device of the present invention, the liquid crystal display device has an external terminal that receives an external clock signal. The timing setting circuit sets at least one of the driving timing of the scanning lines and the driving timing of the data lines based on serial number(s) corresponding to the counter value of the counter. The serial number(s) indicates the number(s) of clocks of the external clock signal. Further, the timing setting circuit fixes the driving timing of the scanning lines and the driving timing of the data lines to predetermined serial numbers, respectively, when the cycle of the synchronous signal exceeds a predetermined value. Therefore, with a longer value than this predetermined value, the writing time becomes longer depending on the cycle of the synchronous signal. However, the increase in the writing time does not cause any deterioration in display quality. This allows the reduction in circuit scale of the timing setting circuit.

According to another aspect of the liquid crystal display device of the present invention, the liquid crystal display device has an oscillator which generates an internal clock signal. The timing controller has a frame cycle detector, a counter, and a timing setting circuit. The frame cycle detector detects a cycle of one frame for displaying one screen based on the synchronous signal to find the cycle of the synchronous signal. The counter counts the frame cycle detected by the frame cycle detector as the number of clocks of the internal clock signal. The timing setting circuit sets at least one of the driving timing of the scanning lines and the driving timing of the data lines according to a counter value of the counter. The use of the internal clock signal whose cycle is always constant allows correct measurement of one frame cycle. Further, the measurement of one frame cycle allows the detection of an average value of the cycle of the synchronous signal. As a result, accurate setting is enabled compared with a case where the driving timing of the scanning lines and the driving timing of the data lines are set according to one-time measurement of the cycle of the synchronous signal.

According to another aspect of the liquid crystal display device of the present invention, the liquid crystal display device has an external terminal which receives an external clock signal. The timing setting circuit sets at least one of the driving timing of the scanning lines and the driving timing of the data lines based on serial number(s) corresponding to the counter value of the counter. The serial number(s) indicates the number(s) of clocks of the external clock signal. The driving timing of a liquid crystal panel is set based on the serial number of the external clock signal being a basic clock for driving the liquid crystal panel, which allows easy and accurate generation of the driving timing.

According to another aspect of the liquid crystal display device of the present invention, the timing setting circuit assigns the serial number to each of a plurality of counter groups each consisting of the plural continuous counter values. Further, the timing setting circuit sets each of the driving timings based on each of the serial numbers corresponding to one of the counter groups including the counter value of the counter. For example, the timing setting circuit has a table which contains the counter groups and the serial numbers assigned to the respective counter groups. The serial number is assigned to each of the plural counter groups each representing the continuous plural counter values, which allows the reduction in circuit scale of the timing setting circuit. For example, the constitution of the table representing the counter groups and the corresponding serial numbers facilitates circuit designing and change thereof.

According to another aspect of the liquid crystal display device of the present invention, a difference detector of the timing controller detects, as a change in the cycle of the synchronous signal, a difference between a preset standard counter value and the counter value outputted from the counter. The timing setting circuit operates the difference to find at least one of the serial numbers indicating the driving timing of the scanning lines and the driving timing of the data lines. The serial number is found by the operation, instead of being stored so as to correspond to the counter values, which allows the reduction in circuit scale of the timing setting circuit.

According to another aspect of the liquid crystal display device of the present invention, the timing setting circuit sets the number of shifts in the serial number indicating the driving timing of the scanning lines to a value (integer) obtained by multiplying a ratio P1/P2 by the difference, P1 being a cycle of the internal clock signal and P2 being a preset standard cycle of the external clock signal. This makes it possible to easily find the number of shifts of the external clock signal (the serial number) according to the difference in the counter values detected by the difference detector. The number of shifts can be also easily found even when the cycle of the external clock signal and that of the internal clock signal significantly differ from each other.

According to another aspect of the liquid crystal display device of the present invention, the timing setting circuit sets the number of shifts in the serial number indicating the driving timing of the data lines to a value (integer) obtained by multiplying a ratio P1/P2 by the difference, P1 being a cycle of the internal clock signal and P2 being a preset standard cycle of the external clock signal. This makes it possible, as in the above, to easily find the number of shifts even when the cycle of the external clock signal and that of the internal clock signal significantly differ from each other.

According to another aspect of the liquid crystal display device of the present invention, the timing setting circuit sets the sum of the number of shifts in the serial number indicating the driving timing of the scanning lines and the number of shifts in the serial number indicating the driving timing of the data lines, to a value (integer) obtained by multiplying a ratio P1/P2 by the difference, P1 being a cycle of the internal clock signal and P2 being a preset standard cycle of the external clock signal. This makes it possible, as in the above, to easily find the number of shifts even when the cycle of the external clock signal and that of the internal clock signal significantly differ from each other.

BRIEF DESCRIPTION OF THE DRAWINGS

The nature, principle, and utility of the invention will become more apparent from the following detailed description when read in conjunction with the accompanying drawings in which like parts are designated by identical reference numbers, in which.

DESCRIPTION OF THE PREFERRED EMBODIMENTS

Figure 1:
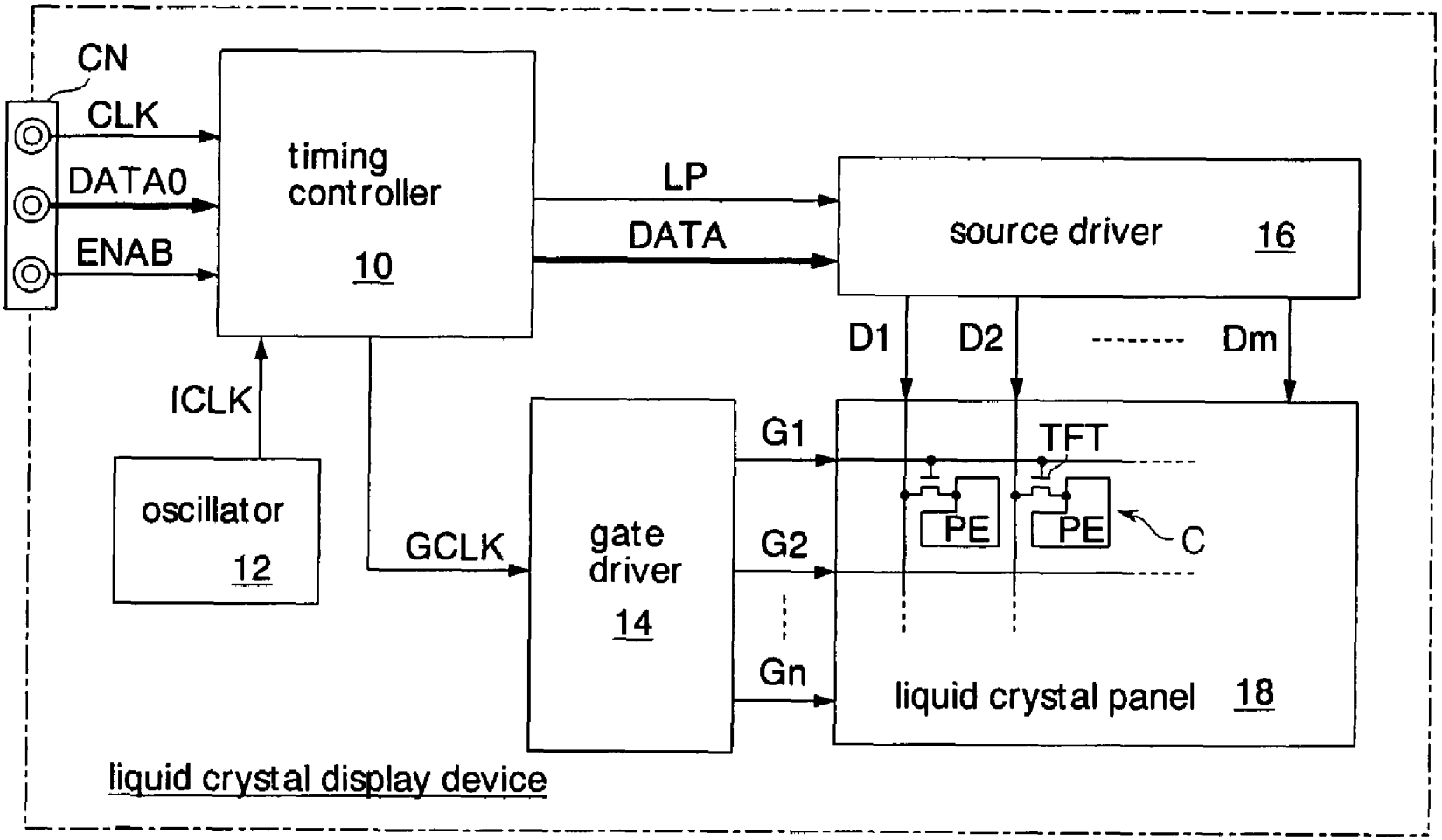
FIG. 1 is a block diagram showing a first embodiment of the present invention.

Hereinafter, embodiments of the present invention will be described with reference to the drawings. The double circles in the drawing represent external terminals. In the drawings, each signal line shown by the heavy line is constituted of a plurality of lines. Further, part of a block to which the heavy line is connected is constituted of a plurality of circuits. The same reference numerals and symbols as those of the external terminals are used to designate signals supplied via the external terminals. Further, the same reference numerals and symbols as those of the signals are used to designate signal lines through which the signals are transmitted.

FIG. 1 shows a first embodiment of the present invention. A liquid crystal display device is connected to, for example, a not-shown personal computer via a connector CN. The personal computer has a control unit which converts picture sources (such as video, DVD, or television signals) to signals with various resolutions and frequencies. The control unit temporarily stores the picture signal in a not-shown line memory or frame memory, so that it can set the output timings of the picture signal and control signals to desired values. The liquid crystal display device has a timing controller 10, an oscillator 12, a gate driver 14, a source driver 16, and a liquid crystal panel 18.

The timing controller 10 receives a clock signal CLK (an external clock signal, a dot clock signal), a data signal (a picture signal) DATA0, and an enable signal ENAB (a synchronous signal), which are supplied via external terminals of the connector CN, and an internal clock signal ICLK from the oscillator 12, and outputs a gate clock signal GCLK to the gate driver 14 and a latch pulse signal LP and a data signal (a picture signal) DATA to the source driver 16. The clock signal CLK is a basic clock signal for putting the timing controller 10 into operation. The enable signal ENAB is a horizontal synchronous signal for dividing the data signal DATA0 among respective horizontal lines and is a positive pulse signal that rises in synchronization with the start of transferring the data signal DATA0 of each of the horizontal lines, as will be described later. The gate clock signal GCLK and the latch pulse signal LP are generated in synchronization with the enable signal ENAB. The data signal DATA has the same information as that of the data signal DATA0. The timing controller 10 will be described in FIG. 2 in detail.

The oscillator 12 is constituted of, for example, a crystal oscillator, a control circuit thereof, and so on, and it generates the internal clock signal ICLK with a higher frequency than that of the clock signal CLK. The gate driver 14 outputs gate pulses to scanning lines G1 to Gn in sequence, in synchronization with the gate clock signal GCLK. The source driver 16 receives the data signals DATA from the respective horizontal lines in sequence in synchronization with the latch pulse signal LP to output the received signals to data lines D1 to Dm.

A liquid crystal panel 18 has liquid crystal cells C formed in intersection areas of the scanning lines G1 to Gn and the data lines D1 to Dm, respectively. Each of the liquid crystal cells C is constituted of a thin film transistor TFT, a pixel electrode PE, and a not-shown liquid crystal and counter electrode. A gate of each of the thin film transistors TFT is connected to any one of the scanning lines G1 to Gn, a drain thereof is connected to any one of the data lines D1 to Dm, and a source thereof is connected to the pixel electrode PE. The counter electrode is disposed to face the pixel electrode PE. Further, the liquid crystal is sandwiched by the pixel electrode PE and the counter electrode to constitute the liquid crystal cell C. Transmitting light of the liquid crystal cell C passes through a three color filter facing the liquid crystal cell C to form a color image. In this embodiment, the number of the scanning lines is 768 (n=768). The number of the data lines is 1024 for each of R (red), G (green), and B (blue) of the three color filter (m=1024). 786 horizontal lines are formed by the liquid crystal cells C arranged along the scanning lines G1 to Gn. Therefore, the latch pulse signal LP is generated 768 times per one frame cycle.

Figure 2:
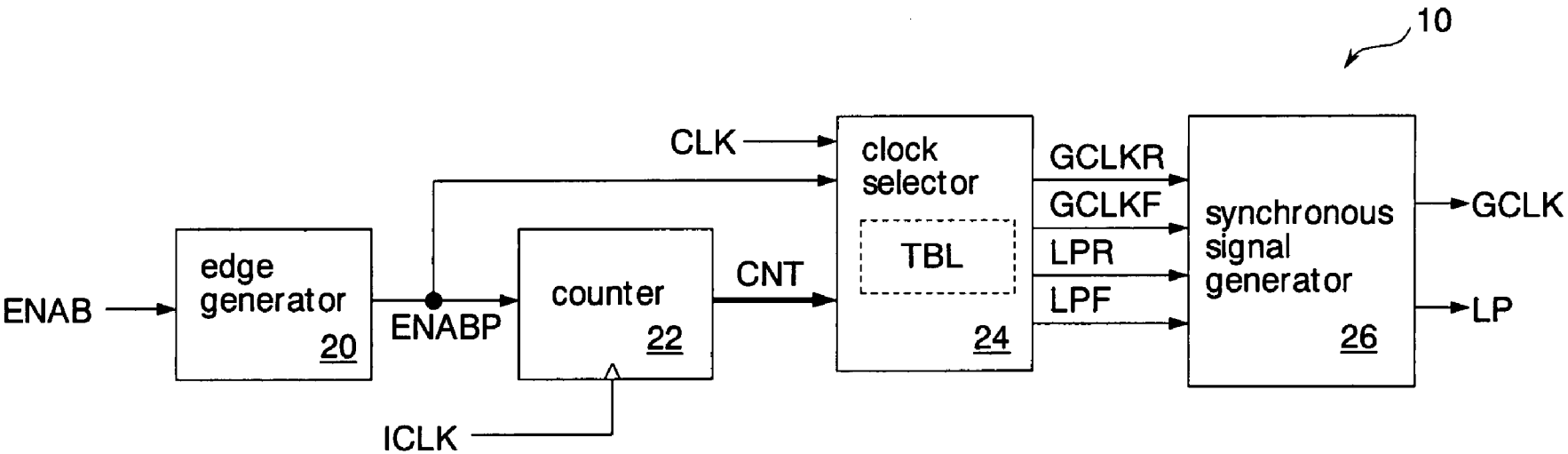
FIG. 2 is a block diagram showing a timing controller shown in FIG. 1 in detail.

FIG. 2 shows the timing controller 10 shown in FIG. 1 in detail. The timing controller 10 has an edge generator 20, a counter 22, a clock selector 24, and a synchronous signal generator 26. The edge generator 20 generates an enable pulse signal ENABP in synchronization with a rising edge of the enable signal ENAB. Therefore, the enable pulse signal ENABP is generated in synchronization with the start of transferring the data signal DATA0 of each of the horizontal lines. The counter 22 counts the pulse generation cycle of the enable pulse signal ENABP outputted from the edge generator 20 as the number of clocks of the internal clock signal ICLK to output a counter value thereof as a counter signal CNT.

The clock selector 24 has a table TBL in which a plurality of sets of four kinds of the numbers of clocks indicating periods from a falling edge of the enable pulse signal ENABP to edge timings of the gate clock signal GCLK and the latch pulse signal LP, respectively, are set. The number of clocks indicates the number of pulses (serial number) of the clock signal CLK, with the falling edge of the enable pulse signal ENABP as a counting basis. The clock selector 24 selects four kinds of the numbers of clocks according to the counter value CNT and it generates the edge timings of the gate clock signal GCLK and the edge timings of the latch pulse signal LP in synchronization with rising edges of the clock signal CLK corresponding to the respective selected numbers of clocks, with the falling edge of the enable pulse signal ENABP as a counting basis. A rising edge timing and a falling edge timing of the gate clock signal GCLK and a rising edge timing and a falling edge timing of the latch pulse signal LP are signified as rising edges of a gate rising signal GCLKR, a gate falling signal GCLKF, a latch rising signal LPR, and a latch falling signal LPF, respectively. The clock selector 24 has a clock counter (not shown) for generating the gate rising signal GCLKR, the gate falling signal GCLKF, the latch rising signal LPR, and the latch falling signal LPF according to the predetermined number of clocks of the clock signal CLK. Thus, the clock selector 24 operates as a timing setting circuit that sets the driving timings of the scanning lines G1 to Gn and the data lines D1 to Dm.

The synchronous signal generator 26 generates the gate clock signal GCLK having falling edges and rising edges that synchronize with rising edges of the gate falling signal GCLKF and the gate rising signal GCLKR, respectively. Further, the synchronous signal generator 26 generates the latch pulse signal LP having falling edges and rising edges that synchronize with rising edges of the latch rising signal LPR and the latch falling signal LPF, respectively.

Figure 3:
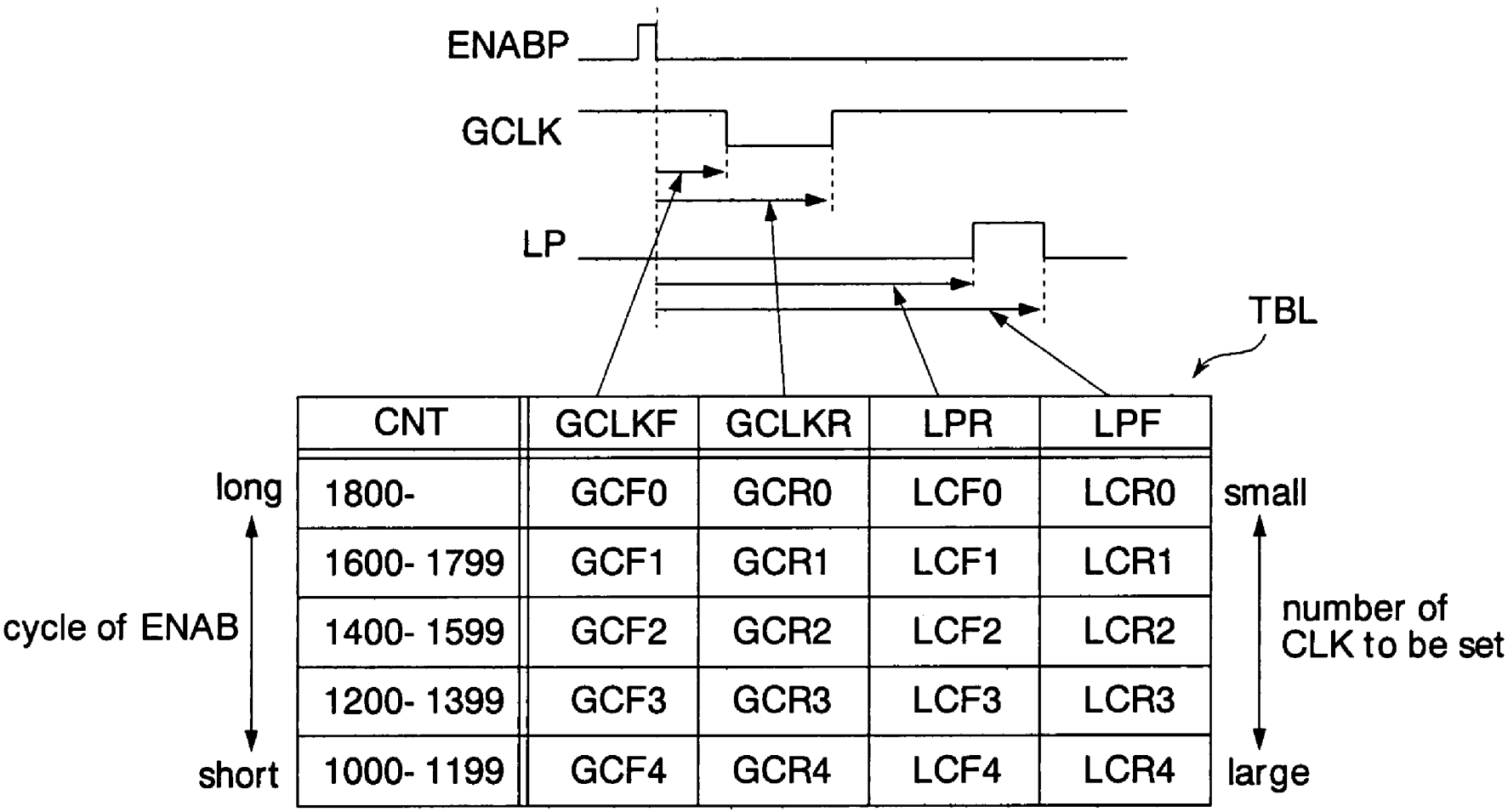
FIG. 3 is an explanatory diagram showing a clock selector 24 shown in FIG. 2 in detail.

FIG. 3 shows the clock selector 24 shown in FIG. 2 in detail. In the table TBL of the clock selector 24, serial numbers GCF (GCF0-GCF4), GCR (GCR0-GCR4) indicating the number of clocks corresponding to the falling edge timing and the rising edge timing of the gate clock signal GCLK, and serial numbers LCR (LCR0-LCR4), LCF (LCF0-LCF4) indicating the number of clocks corresponding the rising edge timing and the falling edge timing of the latch pulse signal LP are stored for respective predetermined ranges of the counter values CNT of the internal clock signal ICLK. Specifically, the table TBL contains a plurality of counter groups "1000-1199", "1200-1399", "1400-1599", "1600-1799", and "1800 or more" each consisting of a plurality of continuous counter values CNT, respectively, and the serial numbers assigned to the respective counter groups.

As will be described later, as the cycle of the enable signal ENAB is longer (the counter value CNT is larger), the number of clocks is set to a smaller value (a smaller serial number is assigned), and as the cycle of the enable signal ENAB is shorter (the counter value CNT is smaller), the number of clocks is set to a larger value (a larger serial number is assigned). When the counter value is 1800 or more, the numbers of clocks (serial numbers) are fixed to initial values GCF0, GCR0, LCR0, and LCF0. Specifically, when the cycle of the enable signal ENAB exceeds a predetermined value, the driving timings of the scanning lines G1 to Gn and the data lines D1 to Dm are fixed to the predetermined serial numbers, respectively. Consequently, a later-described writing time WT gets longer due to its dependency on the cycle of the enable signal ENAB when the cycle of the enable signal ENAB has a larger value than this predetermined value. However, the increase in the writing time WT does not deteriorate display quality of the liquid crystal display device. Therefore, the number of the counter groups can be reduced, which allows the reduction in circuit scale of the timing setting circuit.

Incidentally, five kinds of the numbers of clocks are stored, one kind for every 200 counter values in this embodiment. However, the present invention is not limited to this. The range of the counter values and the kinds of the numbers of clocks are determined according to design specifications of the liquid crystal display device such as the frequency of the internal clock signal ICLK.

When the counter value of the counter 22 is, for example, 1500, the rising edges of the gate falling signal GCLKF and the gate rising signal GCLKR are set to the numbers of clocks GCF2, GCR2 corresponding to the counter group "1400 to 1599" including this counter value. Similarly, the rising edges of the latch rising signal LPR and the latch falling signal LPF are set to the number of clocks LCR2, LCF2, respectively.

Figure 4:
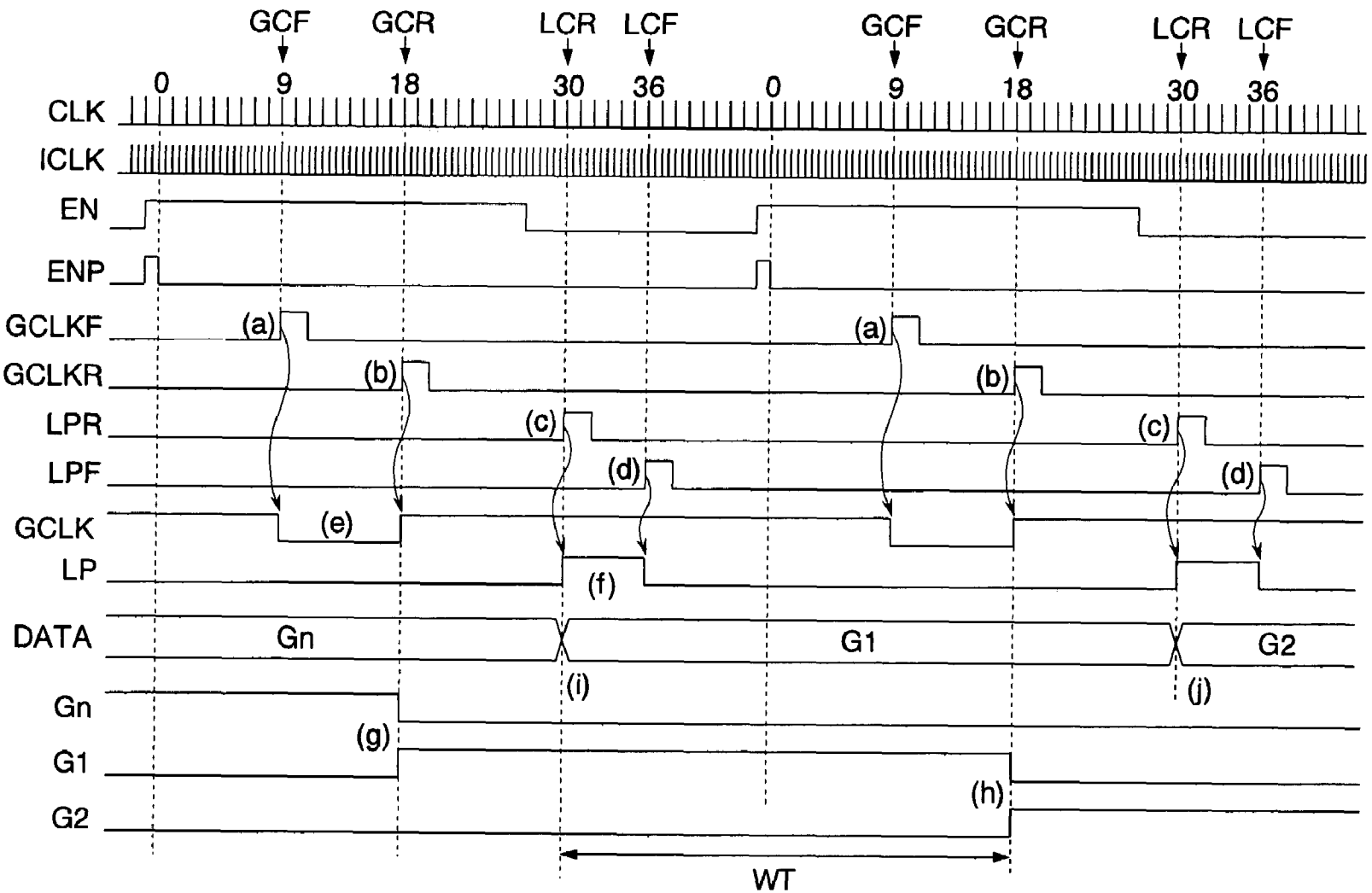
FIG. 4 is a timing chart showing an example of the operation of a liquid crystal display device of the first embodiment.

FIG. 4 shows an example of the operation of the liquid crystal display device of the first embodiment. In this example, the clock signal CLK and the enable signal ENAB outputted from the personal computer connected to the liquid crystal display device of the present invention have frequencies of standard values. The clock selector 24 shown in FIG. 2 selects four serial numbers in the table TBL according to the counter value CNT outputted from the counter 22. The clock selector 24 generates the gate falling signal GCLKF, the gate rising signal GCLKR, the latch rising signal LPR, and the latch falling signal LPF having the rising edges corresponding to the selected serial numbers GCF, GCR, LCR, LCF (the number of clocks counted from the output of the enable signal ENAB) (FIG. 4(*a, b, c, d*)).

Note that the number of clocks in one horizontal line period of the clock signal CLK is assumed to be 45, and the numbers of clocks GCF, GCR, LCR, LCF are assumed to be 9, 18, 30, 36, respectively, for simplicity of the explanation. In practice, if the number of vertical lines of the liquid crystal panel 18 is, for example, 1024, the number of clocks in one horizontal line period of the clock signal CLK being a dot clock is more than 1024. Therefore, the numbers of clocks GCF, GCR, LCR, LCF have larger values than those shown in FIG. 4.

The synchronous signal generator 26 generates transition edges of the gate clock signal GCLK in synchronization with the gate falling signal GCLKF and the gate rising signal GCLKR (FIG. 4(*e*)), and generates transition edges of the latch pulse signal LP in synchronization with the latch rising signal LPR and the latch falling signal LPF (FIG. 4(*f*)). The gate driver 14 shown in FIG. 1 drives the scanning lines G1 to Gn to high level in sequence in synchronization with the rising edges of the gate clock signal GCLK (FIG. 4(*g, h*)). The source driver 16 receives the data signals DATA from the respective horizontal lines in sequence in synchronization with the rising edges of the latch pulse signal LP and outputs the received signals to the data lines D1 to Dm (FIG. 4(*l, j*)). For example, the writing time WT of image data written to the liquid crystal cell C connected to the scanning line G1 is from an instant at which the image data is supplied to the horizontal line corresponding to the scanning line G1 to an instant at which the scanning line G1 is changed to low level. The writing times WT for the other scanning lines G2 to Gn are the same.

Figure 5:
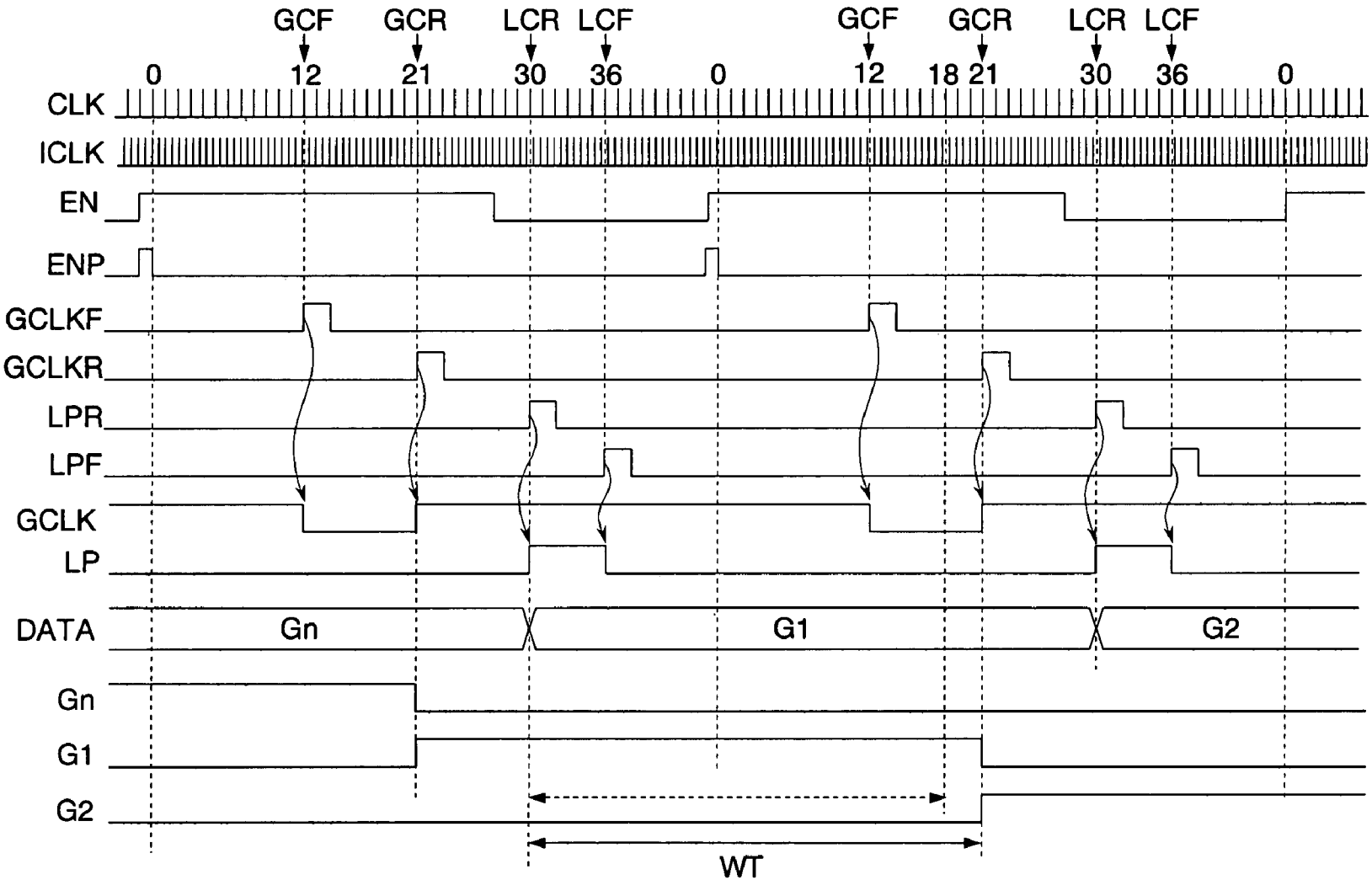
FIG. 5 is a timing chart showing another example of the operation of the liquid crystal display device of the first embodiment.

FIG. 5 shows another example of the operation of the liquid crystal display device of the first embodiment. In this example, the personal computer sets the frequencies of the clock signal CLK and the enable signal ENAB higher than the standard values shown in FIG. 4. The frequency of the internal clock signal ICLK is independent from the frequency of the clock signal CLK and thus is constant. Since one horizontal period is shorter, the number of clocks (counter value CN-0 of the internal clock signal ICLK, which is counted by the counter 22, corresponding to one horizontal period is smaller compared with that in FIG. 4.

The clock selector 24 selects four kinds of the numbers of clocks GCF, GCR, LCR, LCF from the table TBL according to the counter value CNT, and generates the gate falling signal GCLKF, the gate rising signal GCLKR, the latch rising signal LPR, and the latch falling signal LPF. In this example, the number of clocks in one horizontal line period of the clock signal CLK is the same as that in FIG. 4, namely, 45 and the numbers of clocks GCF, GCR, LCR, LCF are 12, 21, 30, 36, respectively. Therefore, the numbers of clocks GCF, GCR indicating the transition edge of the gate clock signal GCLK are set larger by three clocks, and the numbers of clocks LCR, LCF indicating the transition edge of the latch pulse signal LP are set to the same values as in FIG. 4.

The generation timing of the gate clock signal GCLK is delayed by the increase in the numbers of clocks GCF, GCR. This can prevent the reduction in the practical writing time WT even when the frequency of the clock signal CLK is set higher. Consequently, the decrease in a timing margin of control signals such as GCLK and LP outputted from the timing controller 10 is prevented, which prevents the occurrence of such a problem that part of a display area of the liquid crystal panel 18 is darkened. This results in the prevention of quality deterioration of the liquid crystal display device. The broken-line arrow in the drawing shows the writing time when the numbers of clocks GCF, GCR, LCR, LCF are the same as those in FIG. 4.

Incidentally, the practical writing time can be made equal to that in FIG. 4 not only in the manner described in the above examples but also in such a manner that the numbers of clocks GCF, GCR indicating the transition edge of the gate clock signal GCLK are set to the same values as in FIG. 4 and the numbers of clocks LCR, LCF indicating the transition edge of the latch pulse signal LP are decreased by three clocks, respectively. Further, the increase in the numbers of clocks GCF, GCR by two clocks and the decrease in the numbers of clocks LCR, LCF by one clock can make the practical writing time equal to that in FIG. 4. Moreover, the difference between the numbers of clocks GCF, GCR may be set larger than the difference "9" shown in FIG. 4 in order to keep a low level period of the gate clock signal GCLK constant. Similarly, the difference between the numbers of clocks LCF, LCR may be larger than the difference "6" shown in FIG. 4 in order to keep a pulse width of the latch pulse signal LP constant.

Figure 6:
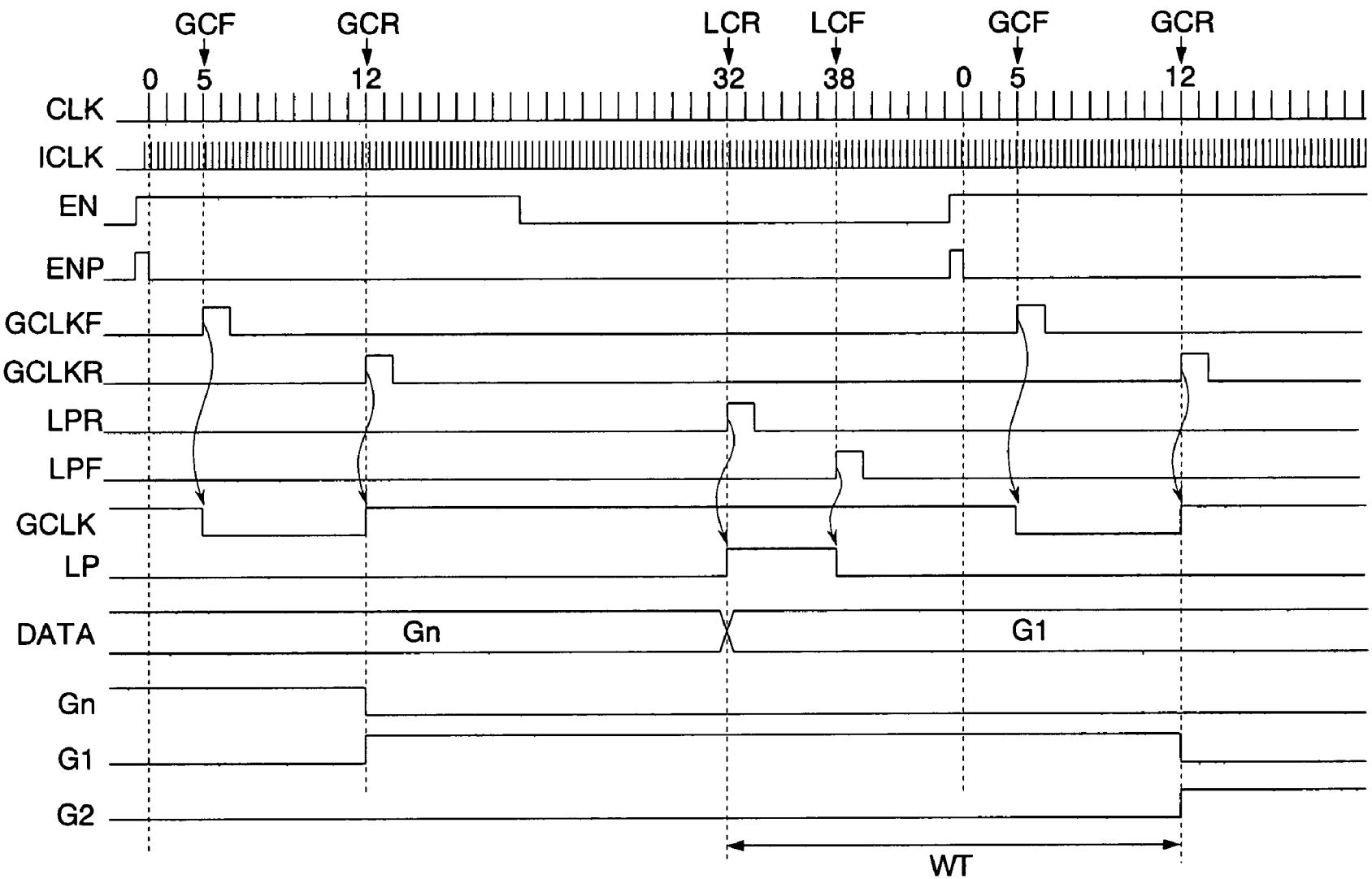
FIG. 6 is a timing chart showing still another example of the operation of the liquid crystal display device of the first embodiment.

FIG. 6 shows still another example of the operation of the liquid crystal display device of the first embodiment. In this example, the personal computer sets the frequencies of the clock signal CLK and the enable signal ENAB lower than the standard values shown in FIG. 4. Since one horizontal period is longer, the number of clocks (counter value CNT) of the internal clock signal ICLK, which is counted by the counter, corresponding to one horizontal period is increased compared with that in FIG. 4.

The clock selector 24 selects four kinds of the numbers of clocks GCF, GCR, LCR, LCF from the table TBL according to the counter value CNT and generates the gate falling signal GCLKF, the gate rising signal GCLKR, the latch rising signal LPR, and the latch falling signal LPF. In this example, the number of clocks in one horizontal line period of the clock signal CLK is also the same as that in FIG. 4, namely, 45. The numbers of clocks GCF, GCR, LCR, LCF selected from the table TBL are 3, 12, 32, 38, respectively. Therefore, the numbers of clocks GCF, GCR indicating the transition edge of the gate clock signal GCLK are smaller than those in FIG. 4 by six clocks, and the numbers of clocks LCR, LCF indicating the transition edge of the latch pulse signal LP are larger than those in FIG. 4 by two clocks. The generation timing of the gate clock signal GCLK is put forward by the decrease in the numbers of clocks GCF, GCR. The generation timing of the latch pulse signal LP is delayed by the increase in the numbers of clocks LCR, LCF. This can prevent the increase in the practical writing time WT even when the frequency of the clock signal CLK gets lower.

Incidentally, the writing time WT may be adjusted by further decreasing the numbers of clocks GCF, GCR without any change in the numbers of clocks LCR, CLF, or may be adjusted by further increasing the numbers of clocks LCR, LCF without any change in the numbers of clocks GCF, GCR. Further, the difference between the numbers of clocks GCF, GCR may be set smaller than the difference "8" shown in FIG. 4 in order to keep the low level period of the gate clock signal GCLK constant. Similarly, the difference between the numbers of clocks LCF, LCR may be set smaller than the difference "6" shown in FIG. 4 in order to keep the pulse width of the latch pulse signal LP constant.

In this embodiment described above, at least one of the driving timing of the scanning lines G1 to Gn and the driving timing of the data lines D1 to Dm is changed according to the cycle of the enable signal ENAB, so that the writing time WT can be kept constant even when the cycle of the enable signal ENAB gets shorter. As a result, the deterioration in display quality of the liquid crystal display device can be prevented. The driving timing is set based on the serial number of the clock signal CLK that is a dot clock, so that the driving timing can be easily and accurately generated.

The use of the internal clock signal ICLK with a constant oscillation cycle generated by the oscillator 12 allows correct measurement of the cycle of the enable signal ENAB. As a result, at least one of the driving timing of the scanning lines G1 to Gn and the driving timing of the data lines D1 to Dm can be adjusted with high precision.

The driving timings of the scanning lines G1 to Gn and the data lines D1 to Dm are fixed when the cycle of the enable signal ENAB is long, which makes it possible to reduce circuit scale of the clock selector 24 without any deterioration in display quality of the liquid crystal display device. Further, the table TLB is formed in the clock selector 24, which facilitates circuit designing of the clock selector 24 and its change. The table TBL of the clock selector 24 contains the serial numbers assigned to the respective counter groups, which allows the reduction in circuit scale of the clock selector 24.

Figure 7:
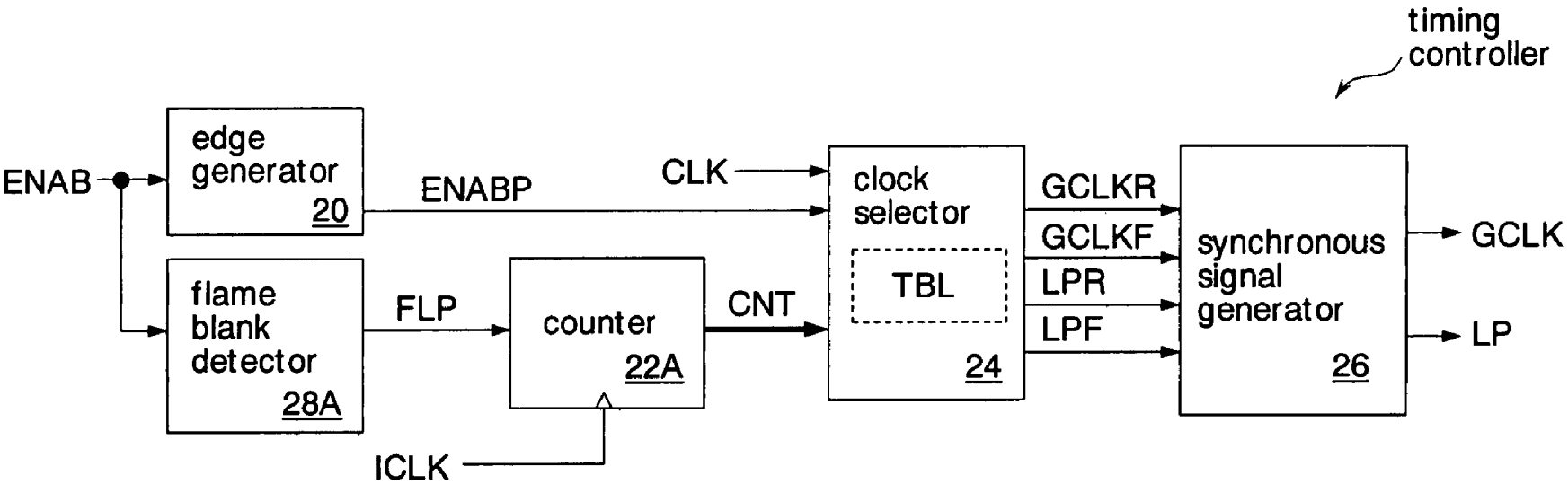
FIG. 7 is a block diagram showing a timing controller of a second embodiment of the present invention in detail.

FIG. 7 shows a second embodiment of the present invention. The same reference numerals and symbols are used to designate the same elements as those explained in the first embodiment, and detailed explanation thereof will be omitted. In this embodiment, a timing controller is different from the timing controller 10 of the first embodiment. The other configuration is the same as that of the first embodiment, and therefore, only the timing controller is shown in FIG. 7.

The timing controller in this embodiment adjusts the generation timing of a gate clock signal GCLK and a latch pulse signal LP according to the number of clocks of an internal clock signal ICLK corresponding to one frame cycle. For this purpose, the timing controller has a counter 22A and a clock selector 24A in place of the counter 22 and the clock selector 24 of the timing controller 10 (FIG. 2) of the first embodiment. The timing controller further has a frame blank detector 28A. The other configuration is substantially the same as that of the timing controller 10 of the first embodiment.

The frame blank detector 28A receives an enable signal ENAB to detect a frame blank period existing in one frame period and outputs a frame cycle signal FLP (pulse signal) in synchronization with the detection timing of the frame blank period. Here, the frame blank period is a period during which a data signal DATA (picture signal) is not transmitted, in one frame period for displaying one screen on a liquid crystal panel, and is a period up to the start of outputting a data signal DATA of a next frame by a personal computer connected to the liquid crystal display device after it has outputted all the data signals DATA corresponding to one frame. Since the frame blank period is detected once per one frame period, the pulse generation cycle of the frame cycle signal FLP indicates one frame period. Thus, the frame blank detector 28A operates as a frame cycle detector that detects one frame cycle based on the enable signal ENAB. Note that the number of pulses of the enable signal ENAB generated during one frame period does not change when the number of vertical lines (for example, 1024 lines) does not change. Therefore, the cycle of the enable signal ENAB can be indirectly detected based on the detection of one frame cycle if the frame blank period does not change.

The counter 22A counts the pulse generation cycle of the frame cycle signal FLP outputted from the frame blank detector 28A as the number of clocks of an internal clock signal ICLK, and outputs a counter value CNT thereof as a count signal CNT. This means that the counter value CNT indicates the number of clocks in one frame period. The clock selector 24A (timing setting circuit) has the same function as that in first embodiment. In this embodiment, however, since the counter value CNT indicates one frame period, numerical values stored in the column of the counter value CNT of the table TBL shown in the above-described FIG. 3 are different from those of the first embodiment. Other values of the table TBL are the same as those of the first embodiment.

The same effects as those of the above-described first embodiment are also obtainable in this embodiment. Moreover, the measurement of one frame cycle allows the detection of an average value of the cycle of the enable signal ENAB in this embodiment. As a result, the driving timings of scanning lines G1 to Gn and data lines D1 to Dm can be accurately set compared with the case where the cycle of the enable signal ENAB is set based on one measurement.

Figure 8:
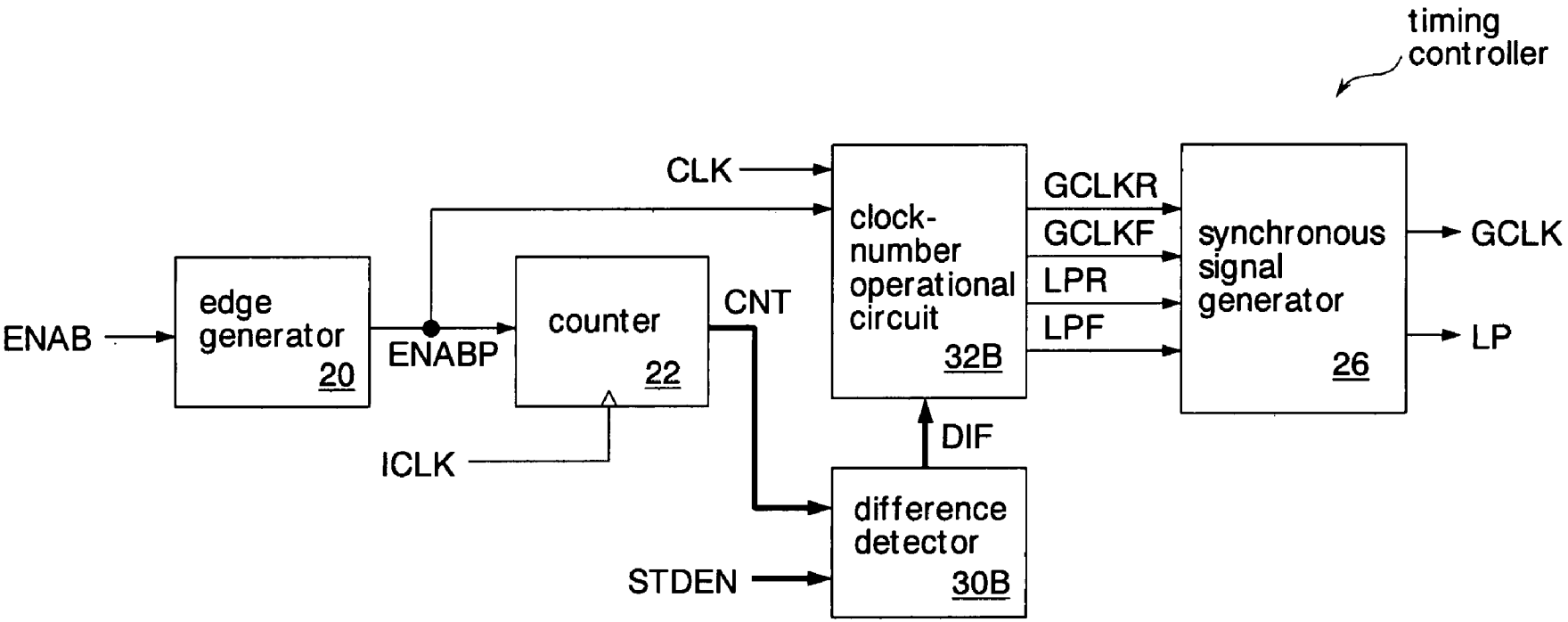
FIG. 8 is a block diagram showing a timing controller of a third embodiment of the present invention in detail.

FIG. 8 shows a third embodiment of the present invention. The same reference numerals and symbols are used to designate the same elements as those explained in the first and second embodiments, and detailed explanation thereof will be omitted. In this embodiment, a timing controller is different from the timing controller 10 of the first embodiment. The other configuration is the same as that of the first embodiment. Therefore, only the timing controller is shown in FIG. 8.

The timing controller of this embodiment has a difference detector 30B and a clock-number operational circuit 32B (timing setting circuit) in place of the clock selector 24 of the timing controller 10 (FIG. 2) of the first embodiment. The other configuration is substantially the same as that of the first embodiment.

The difference detector 30B detects a difference DIF between a counter value CNT, which indicates one horizontal period, outputted from a counter 22 and a standard value STDEN representing a preset standard counter value of one horizontal period (the number of clocks in one horizontal period of an internal clock signal ICLK), and outputs the detected value as a difference signal DIF. The difference detector 30B detects the difference DIF as a change in the cycle of an enable signal ENAB. The clock-number operational circuit 32B generates a gate falling signal GCLKF, a gate rising signal GCLKR, a latch rising signal LPR, and a latch falling signal LPF according to the difference (DIF) in the counter value indicated by the difference signal DIF.

For example, when the counter value CNT is within a predetermined range relative to the standard value STDEN, the clock-number operational circuit 32B outputs the gate falling signal GCLKF, the gate rising signal GCLKR, the latch rising signal LPR, and the latch falling signal LPF at the timings shown in FIG. 4 described above. The clock-number operational circuit 32B judges that the frequencies of a clock signal CLK and the enable signals ENAB are increased when the counter value CNT is smaller than the standard value STDEN by a predetermined value or more. Then, the clock-number operational circuit 32B delays the generation timing of a gate clock signal GCLK by, for example, the number of clocks (serial number) of the clock signal CLK corresponding to a value (note that this value is an integer) equal to the difference DIF multiplied by a predetermined ratio 20%. In other words, the clock-number operational circuit 32B finds the number of shifts in the serial number in order to change the generation timing of the gate clock signal GCLK according to the cycle of the clock signal CLK. As a result, the number of clocks of the clock signal CLK corresponding to a writing time WT increases, and the writing time WT increases by the decreased amount of the cycle of the clock signal CLK, similarly to the first embodiment.

The clock-number operational circuit 32B judges that the frequencies of the clock signal CLK and the enable signal ENAB are lowered when the counter value CNT is larger than the standard value STDEN by the predetermined value or more. Then, the clock-number operational circuit 32B puts forward the generation timing of the gate clock signal GCLK by, for example, the number of clocks (serial number) of the clock signal CLK corresponding to a value (note that this value is integer) equal to the difference DIF multiplied by the predetermined ratio 20%. As a result, the number of clocks of the clock signal CLK corresponding to the writing time WT is reduced to shorten the writing time WT by an increased amount of the cycle of the clock signal CLK.

The above-mentioned "ratio 20%" is a ratio P1/P2, P1 being the cycle of the internal clock signal ICLK and P2 being a preset standard cycle of the clock signal CLK. Specifically, in this example, the cycle P1 of the internal clock signal ICLK is set to one fifth of the standard cycle P2 of the clock signal CLK. Multiplying the difference DIF by the radio P1/P2 can give the time corresponding to the difference DIF as the number of clocks of the clock signal CLK. Therefore, the clock-number operational circuit 32B only has to increase/decrease the found number of clocks in order to generate the gate falling signal GCLKF, the gate rising signal GCLKR, the latch rising signal LPR, and the latch falling signal LPF for keeping the writing time WT constant.

Incidentally, the number of clocks LCR, LCF for setting transition edges of a latch pulse signal LP may be put forward by the clock number corresponding to 20% of the difference DIF without any change in the numbers of clocks LCR, LCF, when the frequency of the clock signal CLK is judged to have been increased. Similarly, the numbers of clocks LCR, LCF for setting the transition edges of the latch pulse signal LP may be delayed by the number of clocks corresponding to 20% of the difference DIF without any change in the numbers of clocks LCR, LCF, when the frequency of the clock signal CLK is judged to have been lowered. Alternatively, when the frequency of the clock signal CLK is judged to have become higher, the numbers of clocks GCF, GCR may be delayed by the number of clocks corresponding to 10% of the difference DIF and the numbers of clocks LCR, LCF may be put forward by the number of clocks corresponding to 10% of the difference DIF. Similarly, when the frequency of the clock signal CLK is judged to have been lowered, the numbers of clocks GCF, GCR may be put forward by the number of clocks corresponding to 10% of the difference DIF and the number of clocks LCR, LCF may be delayed by the number of clocks corresponding to 10% of the difference DIF.

The same effects as those in the above-described first embodiment are also obtainable in this embodiment. Moreover, in this embodiment, the serial number indicating a variation of the generation timings of the gate clock signal GCLK and the latch pulse signal LP can be found by the arithmetic operation based on the difference DIF without referring to a table TBL. This can reduce circuit scale of the clock-number operational circuit 32B. Further, finding the serial number by the arithmetic operation makes it possible to delicately set the generation timings of the gate clock signal GCLK and the latch pulse signal LP, in accordance with the variation in the cycle of the clock signal CLK. Further, the number of shifts in the serial number of the clock signal CLK can be easily found according to the difference DIF detected by the difference detector 30B even when the cycle of the clock signal CLK and that of the internal clock signal ICLK significantly differ from each other.

Figure 9:
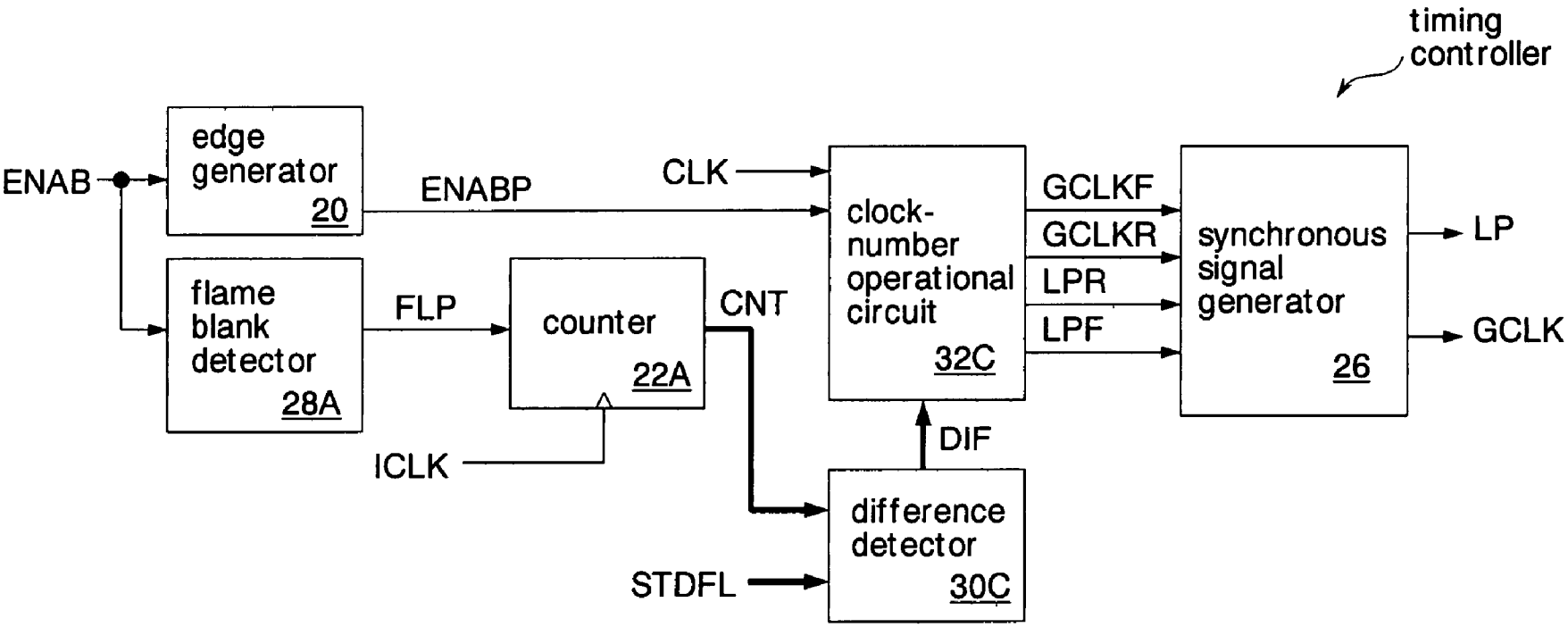
FIG. 9 is a block diagram showing a timing controller of a fourth embodiment of the present invention in detail.

FIG. 9 shows a fourth embodiment of the present invention. The same reference numerals and symbols are used to designate the same elements as those explained in the first to third embodiments, and detailed explanation thereof will be omitted. In this embodiment, a timing controller is different from the timing controller 10 of the first embodiment. The other configuration is the same as that of the first embodiment. Therefore, only the timing controller is shown in FIG. 9.

The timing controller of this embodiment has a counter 22A, a difference detector 30C, and a clock-number operational circuit 32C in place of the counter 22, the difference detector 30B, and the clock-number operational circuit 32B of the third embodiment. It further has the frame blank detector 28A of the second embodiment. The other configuration is substantially the same as that of the third embodiment.

The counter 22A, the difference detector 30C, and the clock-number operational circuit 32C are configured such that the number of bits of each signal line is larger than that of the third embodiment in order to count the number of clocks of an internal clock signal ICLK corresponding to a frame cycle. Basic functions of these circuits 22A, 30C, 32C are the same as those of the counter 22, the difference detector 30B, and the clock-number operational circuit 32B of the third embodiment. Specifically, the counter 22A counts the number of clocks of the internal clock signal ICLK corresponding to one frame cycle. The difference detector 30C finds a difference DIF between a counter value CNT indicating one frame period outputted from the counter 22A and a standard value STDEN representing a preset standard counter value in one frame period (the number of clocks in one frame period of the internal clock signal ICLK), and outputs the found value as a difference signal DIF.

The clock-number operational circuit 32C generates a gate falling signal GCLKF, a gate rising signal GCLKR, a latch rising signal LPR, and a latch falling signal LPF according to the difference DIF in the counter value indicated by the difference signal DIF. Further, the clock-number operational circuit 32C shifts the generation timing of a gate clock signal GCLK by, for example, the number of clocks (the number of clocks of a clock signal CLK) corresponding to 20% of the difference DIF. Incidentally, similarly to the third embodiment, transition edges of a latch pulse signal LP may be shifted by the number of clocks corresponding to 20% of the difference DIF, or transition edges of the gate clock signal GCLK and the latch pulse signal LP may be both shifted by the number of clocks corresponding to 10% of the difference DIF.

The same effects as those of the above-described first to third embodiments are also obtainable in this embodiment.

In the embodiments described above, the examples where the present invention is applied to the liquid crystal display device that receives the enable signal ENAB from the control device such as the personal computer are described. The present invention is not to be limited to such embodiments. For example, the present invention may be applied to a liquid crystal display device that receives a horizontal synchronous signal HSYNC and a vertical synchronous signal VSYNC from a control device. In this case, the present invention is realizable by the use of the horizontal synchronous signal HSYNC in place of the enable signal ENAB.

The invention is not limited to the above embodiments and various modifications may be made without departing from the spirit and scope of the invention. Any improvement may be made in part or all of the components.

What is claimed is:

1. A liquid crystal display device comprising:

external terminals which receives a picture signal and a synchronous signal, respectively; and a timing controller which generates a driving timing of the scanning lines and a driving timing of the data lines in response to the synchronous signal, and enlarges a difference between the driving timing of the scanning lines and the driving timing of the data lines when a cycle of the synchronous signal is long and diminishes the difference when the cycle is short to keep a writing time of the picture signal supplied to the liquid crystal cells constant.

2. The liquid crystal display device according to claim 1, further comprising an oscillator which generates an internal clock signal, wherein said timing controller includes:

a counter which counts the cycle of the synchronous signal as the number of clocks of the internal clock signal; and a timing setting circuit which sets at least one of the driving timing of the scanning lines and the driving timing of the data lines according to a counter value of said counter.

3. The liquid crystal display device according to claim 2, further comprising an external terminal which receives an external clock signal, wherein said timing setting circuit sets, according to the counter value of said counter, at least one of the driving timing of the scanning lines and the driving timing of the data lines based on serial number(s) indicating the number(s) of clocks of the external clock signal, and fixes the driving timing of the scanning lines and the driving timing of the data lines to predetermined serial numbers, respectively, when the cycle of the synchronous signal exceeds a predetermined value.

4. The liquid crystal display device according to claim 2, further comprising an external terminal which receives an external clock signal, wherein said timing setting circuit sets, according to the counter value of said counter, at least one of the driving timing of the scanning lines and the driving timing of the data lines based on serial number(s) indicating the number(s) of clocks of the external clock signal.

5. The liquid crystal display device according to claim 4, wherein said timing setting circuit assigns the serial number to each of a plurality of counter groups each consisting of the plural continuous counter values and sets each of the driving timings based on each of the serial numbers corresponding to one of the counter groups including the counter value of said counter.

6. The liquid crystal display device according to claim 5, wherein said timing setting circuit has a table showing the counter groups and the serial numbers assigned to the respective counter groups.

7. The liquid crystal display device according to claim 4, wherein:

said timing controller includes a difference detector which detects, as a change in the cycle of the synchronous signal, a difference between a preset standard counter value and the counter value outputted from said counter; and said timing setting circuit operates said difference to find at least one of the serial numbers indicating the driving timing of the scanning lines and the driving timing of the data lines.

8. The liquid crystal display device according to claim 7, wherein said timing setting circuit sets the number of shifts in the serial number indicating the driving timing of the scanning lines to a value (integer) obtained by multiplying a ratio P1/P2 by said difference, P1 being a cycle of the internal clock signal and P2 being a preset standard cycle of the external clock signal.

9. The liquid crystal display device according to claim 7, wherein said timing setting circuit sets the number of shifts in the serial number indicating the driving timing of the data lines to a value (integer) obtained by multiplying a ratio P1/P2 by said difference, P1 being a cycle of the internal clock signal and P2 being a preset standard cycle of the external clock signal.

10. The liquid crystal display device according to claim 7, wherein said timing selling circuit sets the sum of the number of shifts in the serial number indicating the driving timing of the scanning lines and the number of shifts in the serial number indicating the driving timing of the data lines, to a value (integer) obtained by multiplying a ratio P1/P2 by said difference, P1 being a cycle of the internal clock signal and P2 being a preset standard cycle of the external clock signal.

11. The liquid crystal display device according to claim 1, further comprising an oscillator which generates an internal clock signal, wherein said timing controller includes:

a frame cycle detector which detects a cycle of one frame for displaying one screen based on the synchronous signal to find the cycle of the synchronous signal;

a counter which counts the frame cycle detected by said frame cycle detector as the number of clocks of the internal clock signal; and a timing selling circuit which sets at least one of the driving timing of the scanning lines and the driving timing of the data lines according to a counter value of said counter.

12. The liquid crystal display device according to claim 11, further comprising an external terminal which receives an external clock signal, wherein said timing setting circuit sets, according to the counter value of said counter, at least one of the driving timing of the scanning lines and the driving timing of the data lines based on serial number(s) indicating the number(s) of clocks of the external clock signal, and fixes the driving timing of the scanning lines and the driving timing of the data lines to predetermined serial numbers, respectively, when the frame cycle exceeds a predetermined value.

13. The liquid crystal display device according to claim 11, further comprising an external terminal which receives an external clock signal, wherein said timing setting circuit sets, according to the counter value of said counter, at least one of the driving timing of the scanning lines and the driving timing of the data lines based on serial number(s) indicating the number(s) of clocks of the external clock signal.

14. The liquid crystal display device according to claim 13, wherein said timing setting circuit assigns the serial number to each of a plurality of counter groups each consisting of the plural continuous counter values and sets each of the driving timings based on each of the serial numbers corresponding to one of the counter groups including the counter value of said counter.

15. The liquid crystal display device according to claim 14, wherein said timing setting circuit has a table showing the counter groups and the serial numbers assigned to the respective counter groups.

16. The liquid crystal display device according to claim 13, wherein:

said timing controller includes a difference detector which detects, as a change in the cycle of the synchronous signal, a difference between a preset standard counter value and the counter value outputted from said counter; and said timing setting circuit operates said difference to find at least one of the serial numbers indicating the driving timing of the scanning lines and the driving timing of the data lines.

17. The liquid crystal display device according to claim 16, wherein said timing setting circuit sets the number of shifts in the serial number indicating the driving timing of the scanning lines to a value (integer) obtained by multiplying a ratio P1/P2 by said difference, P1 being a cycle of the internal clock signal and P2 being a preset standard cycle of the external clock signal.

18. The liquid crystal display device according to claim 16, wherein said timing setting circuit sets the number of shifts in the serial number indicating the driving timing of the data lines to a value (integer) obtained by multiplying a ratio P1/P2 by said difference, P1 being a cycle of the internal clock signal and P2 being a preset standard cycle of the external clock signal.

19. The liquid crystal display device according to claim 16, wherein said timing setting circuit sets the sum of the number of shifts in the serial number indicating the driving timing of the scanning lines and the number of shifts in the serial number indicating the driving timing of the data lines, to a value (integer) obtained by multiplying a ratio P1/P2 by said difference, P1 being a cycle of the internal clock signal and P2 being a preset standard cycle of the external clock signal.

* * * * *